US005971286A

United States Patent [19]

Saxén et al.

[11] Patent Number: 5,971,286

[45] Date of Patent: Oct. 26, 1999

[54] METHOD FOR THE DETERMINATION OF THE GAS FLUX DISTRIBUTION IN A BLAST FURNACE

[76] Inventors: Henrik Saxén, Hernummentie 228, FIN-21500 Pikis; Mats Nikus, Tavastgatan 14 C 38, FIN-20500 Åbo, both of Finland

[21] Appl. No.: 09/043,819

[22] PCT Filed: Sep. 18, 1996

[86] PCT No.: PCT/FI96/00490

§ 371 Date: Mar. 27, 1998

§ 102(e) Date: Mar. 27, 1998

[87] PCT Pub. No.: WO97/12064

PCT Pub. Date: Apr. 3, 1997

[30] Foreign Application Priority Data

Sep. 27, 1995 [FI] Finland ..... 954567

[51] Int. Cl.[6] ..... C21B 7/24

[52] U.S. Cl. ..... 236/15 BR; 432/17; 432/37; 374/137

[58] Field of Search ..... 236/15 R, 15 BR, 236/15 BE, 15 BF; 432/17, 24, 37; 110/186, 190; 374/29, 30, 137

[56] References Cited

U.S. PATENT DOCUMENTS

| | | | |
|---|---|---|---|
| 2,625,386 | 1/1953 | Leone | 236/15 BF X |
| 3,617,037 | 11/1971 | Foch | 432/17 X |
| 4,098,122 | 7/1978 | Landman et al. | 374/137 |
| 4,463,437 | 7/1984 | Schenck et al. | 374/137 X |

FOREIGN PATENT DOCUMENTS

| | | |
|---|---|---|
| 64-65221 | 3/1989 | Japan . |
| 1320233 | 6/1987 | Russian Federation . |
| 1330163 | 8/1987 | Russian Federation . |
| 1573029 | 6/1990 | Russian Federation . |
| 1604858 | 11/1990 | Russian Federation . |
| 1682402 | 10/1991 | Russian Federation . |

OTHER PUBLICATIONS

"Russian Progress in Blast Furnace Automation", *Iron and Steel,* vol. 42, No. 4, pp. 244–246, Aug. 1969.

*Primary Examiner*—Harry B. Tanner
*Attorney, Agent, or Firm*—Burns, Doane, Swecker & Mathis, L.L.P.

[57] ABSTRACT

This invention relates to a method for the determination of the gas flux distribution in the shaft of a blast furnace. The invention is characterized in that: the temperature and optionally also the composition of the gas that has passed through the burden is measuring a probe located above the burden surface, in close vicinity to said surface, at different measurement point (1, 2, 3 . . . ) in the cross section of the shaft; and the temperature and composition of the gas mixture are measured at a point (I) located fiber away from the burden, in which point the gas is completely mixed; and the gas flux distribution is calculated by the use of energy and mass balances for a control volume (V) above the burden surface of the blast furnace, wherein the lower boundary of said volume (V) goes through the measurement points (1, 2, 3 . . . ) and the upper boundary of the volume (V) goes through the measurement point (I).

7 Claims, 2 Drawing Sheets

METHOD FOR THE DETERMINATION OF THE GAS FLUX DISTRIBUTION IN A BLAST FURNACE

Figure 1:
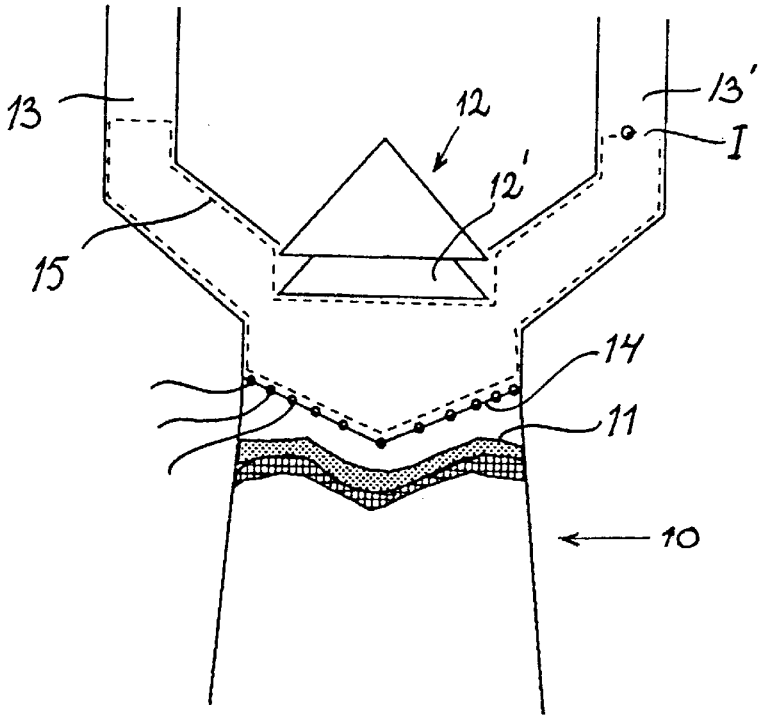

The present invention relates to a method for determining the gas flux distribution in the shaft of a blast furnace. The invention relates further to an arrangement for carrying out the determination.

The gas distribution in the shaft of the blast furnace is of outmost importance. Controlled gas distribution is important for the utility of the gas and for the fuel consumption. A proper gas distribution gives a uniform descent of the burden and an optimal thermal stress of the walls. In practice, a completely uniform distribution throughout the cross section of the shaft of the blast furnace is not aimed at. The object is rather a situation where the gas flux is somewhat higher in the middle of the cross section than at the periphery of the shaft.

Because it is almost impossible to carry out direct and reliable measurements of the gas velocity, one has usually been tried to estimate the gas flux distribution according to indirect methods. The blast furnaces are equipped with a probe located above or below the burden, i.e. on a beam construction extending across the shaft, wherein said beam construction is equipped with temperature probes and gas sampling devices. Said beam construction is typically a beam or star-shaped construction extending across the shaft, said construction comprising radial beams, normally three, extending from the centre of the cross section of the shaft to the periphery.

The most common method used is based on the registration of the temperatures with the probe and the assumption that these temperatures describe the velocity distribution of the gas. The higher the temperature is the greater is, the gas flux. Other methods have also been disclosed in the literature. One known method is based on the temperatures registered by the probe as well as the velocity of the burden surface descent, which is registered by a so called profile indicator. According to another known method the distribution of the burden is first calculated theoretically followed by calculation of the gas distribution by equations of flow technique.

The Russian patent SU 1330163 discloses a method for the determination of the radial distribution of the gas flux in a blast furnace. The gas composition is determined by a probe located below the burden. The temperature of the burden surface is measured at several points by the use of an IR camera. Two consecutive surface temperature measurements are taken at certain intervals after each dump. The gas flux in the different annular zones is calculated from an empirical equation on the basis of the average gas flows, temperatures, the time differences and the specific heat capacity of the burden material. This method has, however, several drawbacks. The measurement of the burden surface temperature requires the expensive IR device and the probe below the burden is prone to wear. Additionally, the determination is based on the assumption that the thickness of the burden layer and the thermal conductivity of the burden material is the same in every measurement point. This assumption differs usually considerably from the conditions encountered in practice. A calculation based on this assumption may therefore lead to very errorneous results.

The object of this invention is to eliminate the problems mentioned above and to provide a new method for the determination of the gas flux in different points of the cross section of the blast furnace shaft. The method according to the invention is accurate and simple in comparison with known methods and it does not require any expensive investments.

The method according to the invention is characterized in that

- the temperature and optionally also the composition of the gas that has passed through the burden is measured using a probe located above the burden surface, in close vicinity to said surface, at different measurement points 1, 2, 3 . . . in the cross section of the shaft, and
- the temperature and composition of the gas mixture are measured at a point I located further away from the burden, in which point the gas is completely mixed, and
- the gas flux distribution is calculated by the use of energy and mass balances for a control volume V above the burden surface of the blast furnace, wherein the lower boundary of said volume V goes through the measurement points 1, 2, 3 . . . and the upper boundary of the volume V goes through the measurement point I.

The arrangement according to the invention is characterized in that it comprises

- a probe located above the burden surface, in close vicinity to said surface, said probe comprising several measurement points for the measurement of the gas temperature and optionally also the gas composition,
- measurement devices to be placed further away from the burden for the measurement of the temperature and the composition of the mixed gas leaving the blast furnace, and
- a programmed processor for calculating the gas flux distribution by the use of energy and mass balances for a control volume V above the burden surface of the blast furnace, wherein the lower boundary of said volume V goes through the measurement points 1, 2, 3 . . . and the upper boundary of the volume V goes through the measurement point In the method according to the invention the measurement points 1, 2, 3 . . . may be located anywhere on the cross section of the blast furnace shaft. In practice, the probes are usually either a beam extending across the shaft of the blast furnace or a beam construction extending along the radius/radii of the shaft, for example a star configuration comprising three radial beams extending from the centre of the cross section of the shaft to the periphery. The most common probe is a beam extending across the cross section of the shaft, wherein said beam in the vertical plane is inclined to form a slight V-shape in order to follow the burden surface profile. In an advantageous configuration the measurement points 1, 2, 3 . . . are placed so that the projection of the line formed by said measurement points, said projection being drawn into the cross section of the shaft, essentially coincides with the diameter of the cross section. According to a preferable embodiment of the method of the invention, the temperature is measured in the measurement points 1, 2, 3 . . . which are located on a beam extending across the blast furnace shaft, through the centre of the cross section of the shaft.

Figure 2:
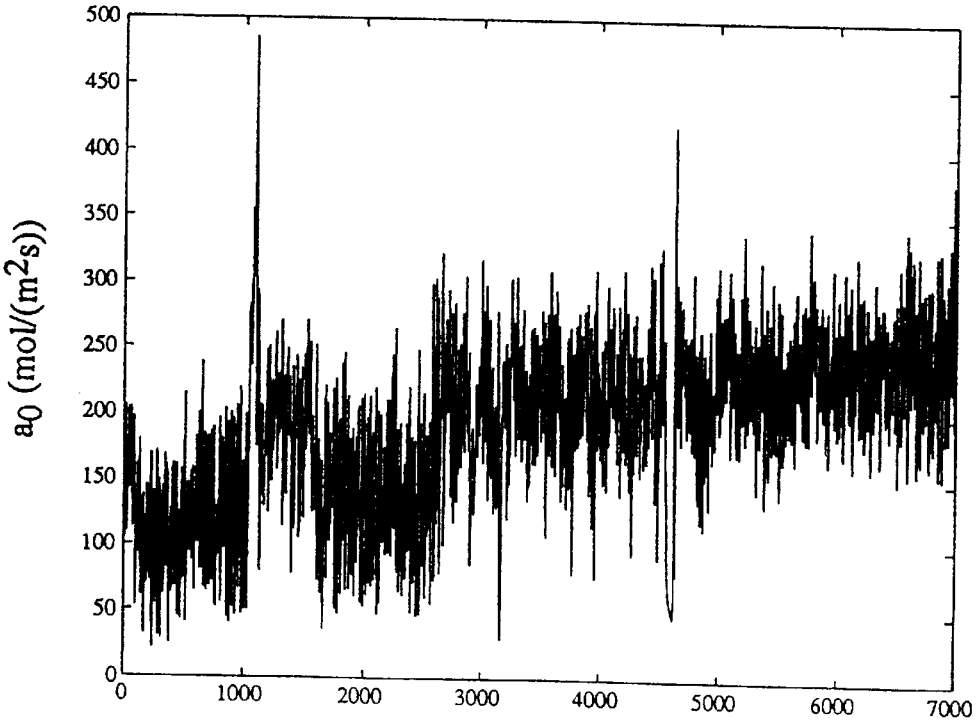
Figure 3A:
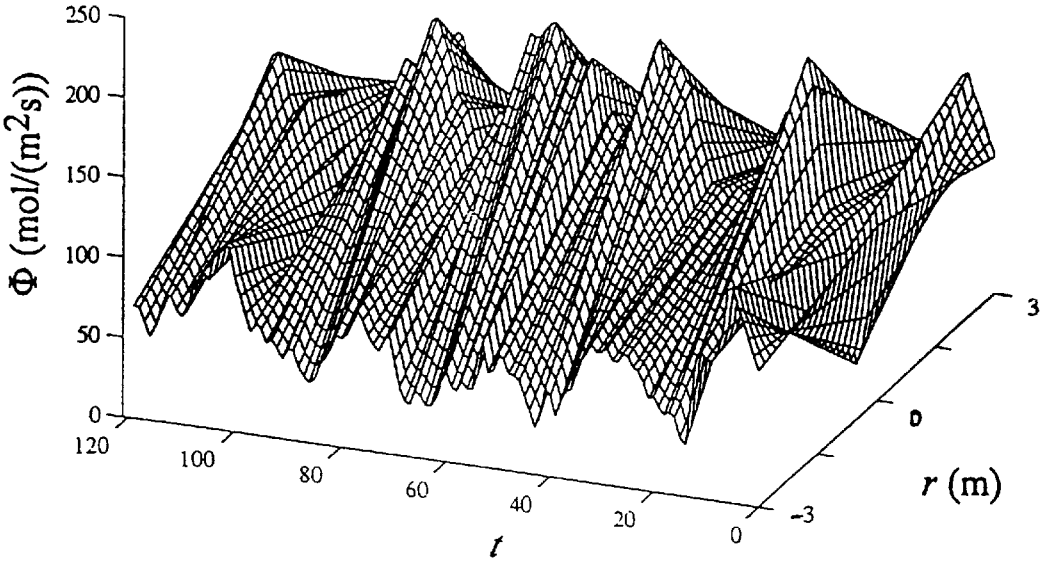
Figure 3B:
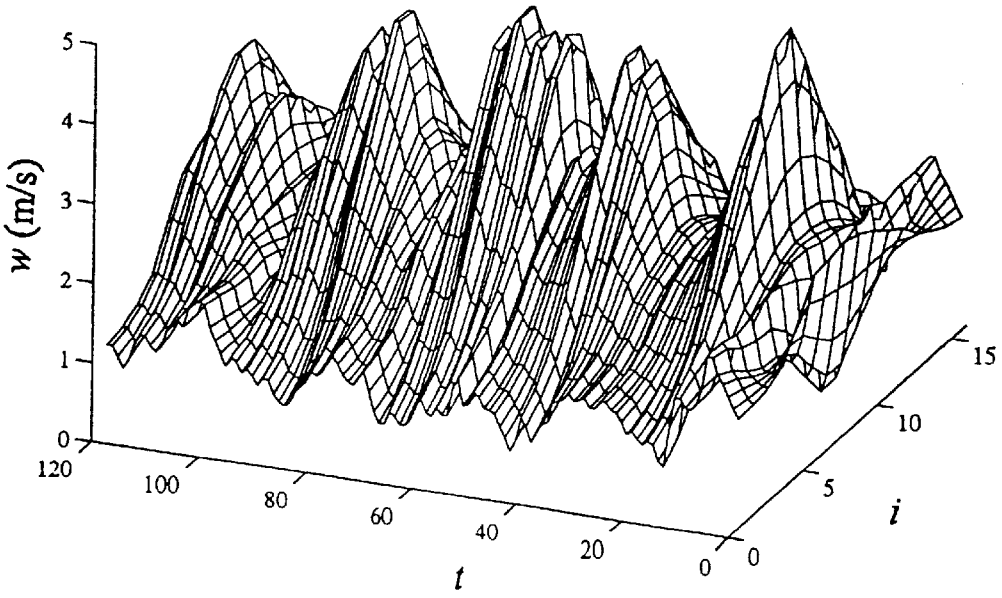

The invention is described more in detailed by reference to the accompanying figures where FIG. 1 shows the vertical cross section of the blast furnace shaft FIG. 2 shows one embodiment of the invention, i.e. a parameter $a_0$ calculated as function of time for a blast furnace, said parameter being calculated according to a uniform radial distribution model FIG. 3A shows the gas flux distribution across the shaft of the blast furnace as function of time during a 10-hour period, the gas flux distribution being calculated with the same model FIG. 3B shows the gas velocity distribution across the shaft of the blast furnace as function of time during a 10-hour period, the gas velocity distribution being calculated with the same model.

FIG. 1, which shows the vertical cross section of the blast furnace shaft 10, illustrates the burden surface 11, the charging equipment 12 and the gas uptakes 13 and 13'. The number of the gas uptakes, 13–13''', is usually four although only two of them have been illustrated in the figure. Through the charging equipment 12 are discontinuously (approximately every 5 minutes) fed sinter or knocking, coke and lime. Below the shaft (not shown in the figure) preheated air is injected into the blast furnace through tuyeres located in an annular pipe. Carbon monoxide, which is formed in the combustion, reduces the iron oxides into pig-iron. The gas comprising carbon oxides ascends through the bed and exits the furnace through the gas uptakes 13–13'''. The charging equipment 12 is made gas-proof by a sealing (not shown in the figure) in order to prevent blast furnace gas from escaping during charging. At charging the material slides down along the the surface of the bell 12'. The material can be steered more or less to the centre of the shaft by movable armors which are located below the charging level. Thus the charging of the material is uniform in every direction. As described before the supply of the gas is also uniform around the cross section of the blast furnace. It is therefore reasonable to assume that the conditions in the shaft of the blast furnace are at least essentially the same in the direction of each radius of the cross section of the shaft, whereas the conditions vary along the length of the radius. Therefore, the cross section of the shaft can be divided into concentric ring zones and the conditions can be expected to be homogenous in the whole area of each ring zone. It can be studied how the conditions vary from one ring zone to another. In the following a mathematical model based on the assumptions above is described more in detail.

The beam shaped probe 14, which is equipped with the measurement points 1, 2, 3 . . . runs across the shaft and is sligthly V-shaped so as to ensure that each measurement point is located essentially on the same distance from the burden surface. The dashed line 15 indicates the boundary of a control volume V, for which mass and energy balances are written. In every measurement point the gas temperatures $T_1$, $T_2$, $T_3$ . . . and optionally also the compositions $x_{j,1}$ . . . are measured. On a sufficient distance from the burden surface, i.e. in point I, which is located at a certain level in the gas uptakes 13–13''', the exiting gas has mixed completely and has assumed the mean temperature $T_{top}$ and composition $x_{j,top}$.

In the following, a mathematical model is presented which is based on a study of the volume V above the burden surface 11, wherein the lower boundary of said volume V goes through the measurement points 1, 2, 3 . . . and the upper boundary of said volume goes through the measurement point I. It is assumed that the gas flux (flow rate per cross sectional area) in the radial direction can be described by the approximating function $\Phi=f(r,a)$, where a is a parameter vector. By writing the balance equations for mass and energy for the control volume V, two equations are obtained which can be used to determine the parameters.

Even a simple model, $\Phi=a_0+a_1r$, provides interesting information about changes in the gas flux distribution. During a test period it was observed that the major changes in distribution occurred at distubances, for instance, at slips where the bed in the shaft collapsed. For the estimate of the parameters it is essential in this approach that the charges cause changes in the temperature of the gas, but that they do not essentially affect the flux distribution.

The gas distribution model makes use of flow balances of energy and material for the region above the burden surface (FIG. 1) and is based on the following assumptions:

- Temperature and/or composition distribution for the gas are measured from a probe located above the burden surface
- The mixing of the gas in the region between the burden surface and the probe is negligible
- No chemical reactions take place above the burden surface
- The temperature, $T_{top}$, and/or the composition, $X_{i,top}$ of the gas is measured in a point where the gas has mixed completely
- The heat loss is proportional to the temperature difference $T_{top}-T_{amb}$, where $T_{amb}$ is the ambient temperature
- The amount of the top gas can be determined from the other variables measured
- The top gas pressure is measured The gas flux distribution in the radial (r) direction in the shaft is expressed e.g. by a polynomial function $$\Phi(r)=\sum_{i=0}^{N} a_i r^i \tag{1}$$

where the molar gas flux, Φ, is defined as the molar flow rate per cross sectional area. Integrating gives the total flux in the throat $$\dot{n}_{tot}=2\pi\int_0^R \Phi(r)r\,dr=2\pi\sum_{i=0}^{N} a_i\frac{R^{i+2}}{i+2}, \tag{2}$$

where R is the throat radius. The energy balance can be expressed as $$\dot{E}_{tot}=2\pi\int_0^R \Phi(r)C_p(r)T(r)r\,dr=\dot{n}_{tot}C_{p,top}T_{top}+\dot{Q}_{loss}. \tag{3}$$

If the heat loss is expressed as $\dot{Q}_{loss}=G(T_{top-Tamb})$, and the reference level of the molar entalpies is set at the ambient temperature, the right hand side of the energy balance can be written as $\dot{n}_{tot}C_{p,top}T_{top}(1+C)$, or briefly $\dot{n}_{tot}C_{p,top}T_{top}$.

Additionally, one can apply partial molar flow balances for M species in the gas (e.g. for the components CO, $CO_2$ and $H_2$). For a species i, the balance can be written as $$x_{i,top}\dot{n}_{tot}=2\pi\int_0^R \Phi(r)x_i(r)r\,dr \tag{4}$$

In practice, the integrals are calculated as sums. We assume that the cross section of the throat is divided into k annular zones, for which the gas temperature and composition measurements are obtained by the probe.

With the above equations, a Kalman filter is used to determine the parameters, $a=[a_0a_1 \ldots a_N]^T$ (eq. (1)) of the gas flux model. The system is first written in the state space form $$a(t+1)=a(t)+e(t)$$

$$y(t)=C(t)a(t)+v(t) \tag{5}$$

where y is the measurement vector, and e and v are vectors of normally distributed noise. C(t) is obtained from eqs. (2) to (4). We thus have $$y = \begin{bmatrix} \frac{\dot{n}_{tot}}{2\pi} \\ \frac{T'_{top} V_{p,top} \dot{n}_{tot}}{2\pi} \\ \frac{x_{1,top} \dot{n}_{tot}}{2\pi} \\ \vdots \\ \frac{x_{M,top} \dot{n}_{tot}}{2\pi} \end{bmatrix} \tag{6}$$

$$C = \begin{bmatrix} \frac{R^2}{2} & \frac{R^3}{3} & \cdots & \frac{R^N}{N} \\ \frac{1}{2}\sum_{j=1}^{k} T_j C_{p,j}(r_j^2 - r_{j-1}^2) & \frac{1}{3}\sum_{j=1}^{k} T_j C_{p,j}(r_j^3 - r_{j-1}^3) & \cdots & \frac{1}{N}\sum_{j=1}^{k} T_j C_{p,j}(r_j^N - r_{j-1}^N) \\ \frac{1}{2}\sum_{j=1}^{k} x_{1,j}(r_j^2 - r_{j-1}^2) & \frac{1}{3}\sum_{j=1}^{k} x_{1,j}(r_j^3 - r_{j-1}^3) & \cdots & \frac{1}{N}\sum_{j=1}^{k} x_{1,j}(r_j^N - r_{j-1}^N) \\ \vdots & \vdots & \vdots & \vdots \\ \frac{1}{2}\sum_{j=1}^{k} x_{M,j}(r_j^2 - r_{j-1}^2) & \frac{1}{3}\sum_{j=1}^{k} x_{M,j}(r_j^3 - r_{j-1}^3) & \cdots & \frac{1}{N}\sum_{j=1}^{k} x_{M,j}(r_j^N - r_{j-1}^N) \end{bmatrix}$$

The parameters (state vector) is obtained from the Kalmnan equations [1)]

$$\hat{a}(t+1|t+1)=\hat{a}(t|t)+K(t+1)[y(t+1)-C(t+1)\hat{a}(t|t)]$$

$$\hat{a}(t_0|t_0)=\bar{a}$$

$$K(t)=P_a(t|t-1)C(t)^T[C(t)P_a(t|t-1)C(t)^T+R_v]^{-1}$$

$$P_a(t|t-1)=P_a(t-1|t-1)+R_e$$

$$P_a(t|t)=P_a(t|t-1)-P_a(t|t-1)C(t)^T[C(t)P_a(t|t-1)C^T+R_v]^{-1}C(t)P_a(t|t-1)$$

$$P_a(t_0|t_0)=R_0 \tag{7}$$

$R_e$ and $R_v$ are the covariance matrices of the state variables and the measurements, respectively, which may be adjusted, e.g. to affect the rate at which the model parameters are allowed to change, and the weighing of the residuals. It should be noted that C is not constant, but the matrix changes with time (along the probe measurements).

Results

In the following the model is applied on process data from a Finnish medium-sized blast furnace. Since the probe in 10 the blast furnace in question measures only the temperatures (in 16 points), only total flow balances of material and energy are used. Additionally, a simple linear flux model is used (N=1 in equation (1))

$$\Phi(r)=a_0+a_1 r \tag{8}$$

so $a=[a_0+a_1]^T$. The molar flow balance is thus $$\dot{n}_{tot} = 2\pi\left(a_0\frac{R^2}{2} + a_1\frac{R^3}{3}\right) \tag{9}$$

Equation (6) yields $$y = \begin{bmatrix} \frac{\dot{n}_{tot}}{2\pi} \\ \frac{T'_{top} C_{p,top} \dot{n}_{tot}}{2\pi} \end{bmatrix} \tag{10}$$

$$C = \begin{bmatrix} \frac{R^2}{2} & \frac{R^3}{3} \\ \frac{1}{2}\sum_{j=1}^{k} T_j C_{p,j}(r_j^2 - r_{j-1}^2) & \frac{1}{3}\sum_{j=1}^{k} T_j C_{p,j}(r_j^3 - r_{j-1}^3) \end{bmatrix}$$

where k =9 annular zones were used in the study. In the following examples the parameters of the model are estimated every 5 minutes.

In FIG. 2 the evolution of the parameter $a_0$ has been depicted for a period of one month. From the figure it is seen that there are major changes at t≈1050, 1600, 2600 and 4600, where the last change is due to a scheduled short shutdown. After t≈2600 the value of $a_0$ is clearly higher, i.e. the blast furnace is more central-working ($a_0<0$ throughout the whole period).

The disturbance at t=1050 is due to a hanging, which forces the operators to reduce the blast volume temporarily by approx. 50%. Even though the blast volume is raised back to its setpoint it takes about two days (600×5 min) until the gas distribution recovers its original shape.

At t≈2570 the charging is delayed and therefore the the blast volume is slightly lowered. The disturbance causes a permanent change in the gas distribution (see FIG. 2). The parameters change from $a_0$≈120 mol/($m^2$s) and $a_1$≈−15 mol/($m^3$s) to $a_0$≈200 mol/($m^2$s) and $a_1$≈−60 mol/($m^3$s).

The gas velocity distribution in the throat can be calculated by the ideal gas law $$w^{(i)} = \frac{\Phi^{(i)} \cdot T^{(i)} \cdot \mathcal{R}}{p_{top}}. \quad (11)$$

where the superscript (i) denotes the number of the measuring point on the probe. FIGS. 3A and 3B show the gas flux and velocity distribution for a 10-hour period. The short-term changes in the distribution clearly correlate with the cast cycle of the furnace: when the hearth of the furnace is filled (before the iron cast), the gas flow is mainly central. Conversely, when the hearth is drained (after the iron cast) the gas flow is peripheral.

The invention is not restricted to the above, as example disclosed model. It is clear for the person skilled in the field that the different embodiments of the invention may vary within the scope of the claims.

Symbols

| | | |
|---|---|---|
| a | model parameter vector (state vector) | — |
| $\hat{a}$ | estimated parameter vector | — |
| c | parameter in heat loss eq. | — |
| $C_p$ | molar heat capacity | kJ/(mol K) |
| C | measurement matrix | — |
| e | noise vector | — |
| $\dot{E}$ | energy flow with gas | W |
| G | heat conductance | W / K |
| K | Kalman gain | — |
| M | number of partial molar balances | — |
| $\dot{n}$ | molar flow of gas | mol/s |
| N | order of polynomial | — |
| p | gas pressure | Pa |
| P | covariance matrix of estimation error | — |
| $\dot{Q}$ | heat flow | W |
| r | radial coordinate | m |
| R | throat radius | m |
| $R_e$ | covariance matrix of state variables | — |
| $R_v$ | covariance matrix of measurements | — |
| t | time | $(5\ \text{min})^{-1}$ |
| T | temperature | ° C. |
| v | noise vector | — |
| w | gas velocity | m/s |
| $x_j$ | molar fraction of the j:th species | — |
| y | measurement vector | — |
| $\Phi$ | molar flux of gas | mol/(m²s) |
| $\mathfrak{R}$ | universal gas constant | 8.314 J/(mol K) |

subscripts

| | |
|---|---|
| amb | ambient |
| loss | heat loss |
| top | top gas |
| tot | total |

Reference

Åström, K. and B. Wittenmark (1984) *Computer controlled systems-Theory and design,* 2 ed., Prentice-Hall International, London.

We claim:

1. A method for determining gas flux distribution in a shaft of a blast furnace comprising:

measuring a temperature of the gas that has passed through a burden using a probe located above a surface of the burden in close vicinity to said surface, at different measurement points in a cross section of the shaft, the temperature of the gas mixture being measured at a point located further away from the burden, at which point the gas is completely mixed, and calculating the gas flux distribution by the use of energy and mass balances for a control volume above the burden surface of the blast furnace, wherein a lower boundary of said volume goes through the measurement points and an upper boundary of the volume goes through said point located further away from the burden.

2. The method according to claim 1 wherein the measurement points are placed so that a projection of a line formed by said measurement points, said projection being drawn into the cross section of the shaft, essentially coincides with a diameter of said cross section.

3. The method according to claim 2 wherein the radial gas flux distribution is calculated using the equation $$\Phi = a_0 + a_1 r$$

where $\Phi$ is the gas flux, r is the radius of the cross section and $a_0$ and $a_1$ are parameter vectors.

4. A method for the control of the gas flux distribution in the shaft of a blast furnace comprising:

measuring a gas flux distribution according to the method of claim 1, comparing the determined gas flux distribution to a predetermined setpoint for the gas flux distribution, and changing a charge distribution, when necessary, so as to give a desired gas flux distribution.

5. The method according to claim 1, including measuring a composition of the gas that has passed through the burden by using a probe.

6. An arrangement for carrying out determination of gas flux distribution in a shaft of a blast furnace comprising:

a probe located above a surface of a burden and in close vicinity to said surface, said probe comprising several measurement points for measuring at least a gas temperature, measurement devices placed further away from the burden than said measurement points for measuring the temperature of mixed gas leaving the blast furnace at another measurement point, and a programmed processor for calculating gas flux distribution by the use of energy and mass balances for a control volume above the surface of the burden of the blast furnace, wherein a lower boundary of said volume goes through the measurement points and an upper boundary of the volume goes through the another measurement point.

7. An arrangement according to claim 5, wherein the measurement points of the probe measure gas composition.

* * * * *